US005539378A

United States Patent [19]

Chang

[11] Patent Number: 5,539,378

[45] Date of Patent: Jul. 23, 1996

[54] LOCK WITH REMOTE ALARM

[76] Inventor: Neng-Chien Chang, 4F, No. 63, Renchung Street, Sanchung, Taipei Hsien, Taiwan

[21] Appl. No.: 291,678

[22] Filed: Aug. 16, 1994

[51] Int. Cl.[6] ..... G08B 13/06

[52] U.S. Cl. ..... 340/542; 340/539

[58] Field of Search ..... 340/542, 539

[56] References Cited

U.S. PATENT DOCUMENTS 4,278,967 7/1981 Tanahashi ..... 340/539

5,311,168 5/1994 Pease, Jr. et al. ..... 340/542

*Primary Examiner*—Glen Swann

*Attorney, Agent, or Firm*—Bacon & Thomas

[57] ABSTRACT

A safety lock having an alarm function includes a transmitter positioned in a main lock body, and a remote receiver with an alarm function. The transmitter is placed in a stand-by state by microswitches activated either by a manually-operated fixing member or movement of latch pins in response to a key, and triggered by a microswitch responsive to full extension of a deadbolt. Under normal conditions, the deadbolt is stopped from fully extending by an adjustable stop, the position of which can be adjusted to adjust the clearance between an extension of the deadbolt and the third microswitch. When the first or second microswitch is activated and the deadbolt disengages from the stop due to an attempt to open the door by prying, cutting, or otherwise forcing the door open, the deadbolt extends fully and the third microswitch is caused to close, triggering the alarm. A manual switch 33 can be provided to actuate the transmitter for test purposes and additional switches can be provided on the receiving device for testing or activating a long duration alarm.

3 Claims, 10 Drawing Sheets

LOCK WITH REMOTE ALARM

BACKGROUND OF THE INVENTION

The present invention relates to a safety lock which has burglary prevention and alarm functions.

A conventional three-stage lock device is widely mounted on a door for achieving a burglary prevention effect. Such lock device includes a deadbolt, latch pins, and a sophisticated key receiving mechanism to prevent a thief from using a universal key to open the door. However, a thief can still use a prying tool to break such a lock device. Therefore, such a lock device cannot completely prevent intrusion of the thief and ensure safety. Therefore, it is necessary to provide an improved lock device to ensure safety.

SUMMARY OF THE INVENTION

It is therefore a primary object of the present invention to provide a safety lock which has burglary preventing and alarm functions. The safety lock of the invention includes a main lock body, a seat member, a signal transmitting means disposed on the main lock body, and a signal receiving means disposed at a remote site. The main lock body includes latch pins, an actuating member, a deadbolt, a fixing member and a key receiving mechanism. A projecting vane plate is integrally stamped or formed on the actuating member and a projecting upright plate is stamped or formed on the fixing member. A transversely projecting rod is disposed on the deadbolt and a microadjustable stopping member is disposed in the seat member for abutting the deadbolt. First, second, and third microswitches are respectively disposed on travel end portions of the vane plate, upright plate and transverse rod to just contact with one another, so that after the first or second microswitch is contacted and actuated, a standby state is attained and in case of a burglar situation, the third microswitch is contacted and actuated to turn on the transmitting means so as to remotely transmit a signal to the receiving means, which there upon emits an alarm to warn and expel the thief or inform the owner to take action.

The present invention can be best understood through the following description and accompanying drawing, wherein:

DETAILED DESCRIPTION OF THE PREFERRED EMBODIMENT

Figures 1, 2:
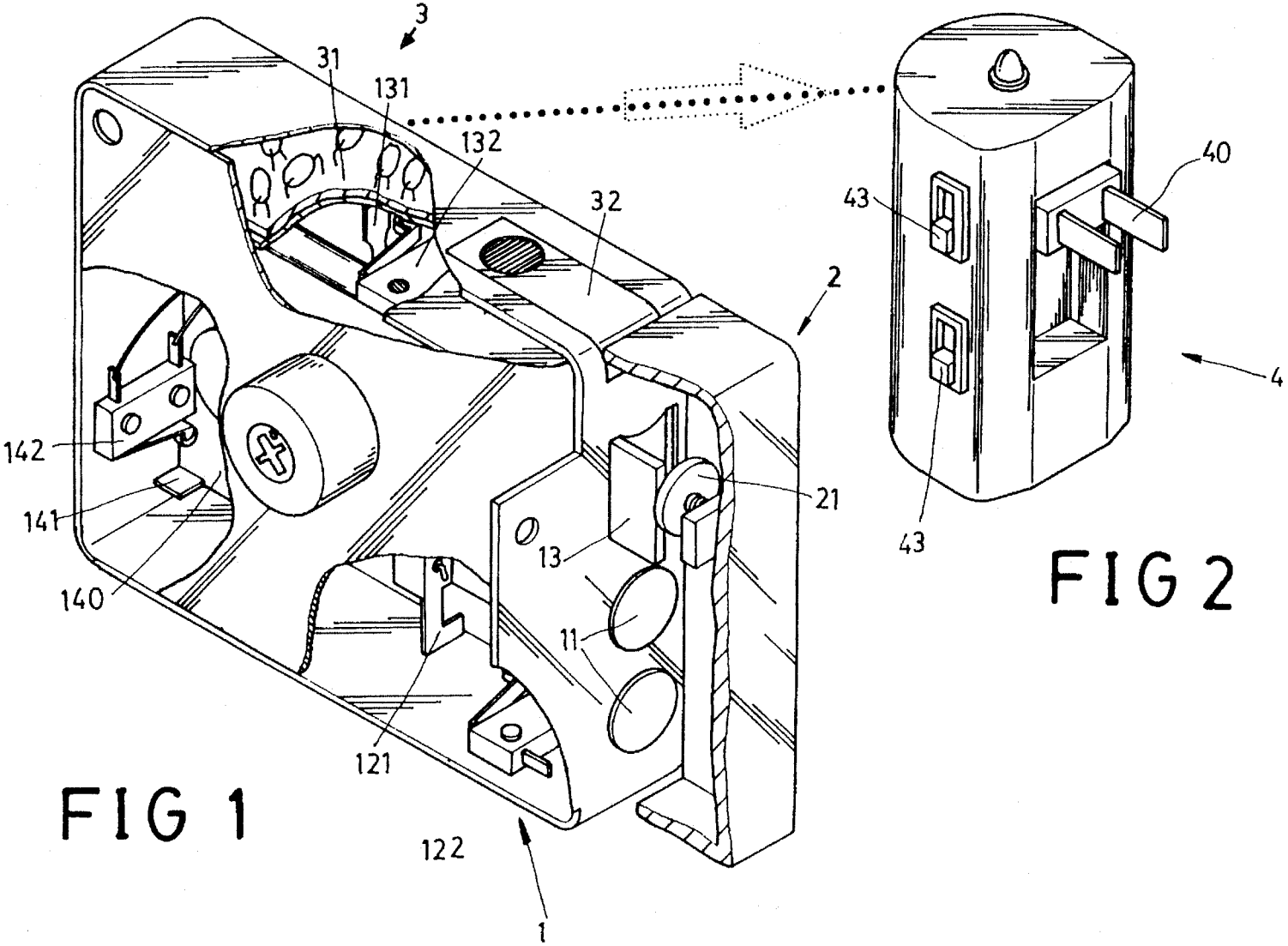
FIG. 1 is a perspective partially sectional view of the present invention.
FIG. 2 is a perspective view of the receiving means.
Figure 3:
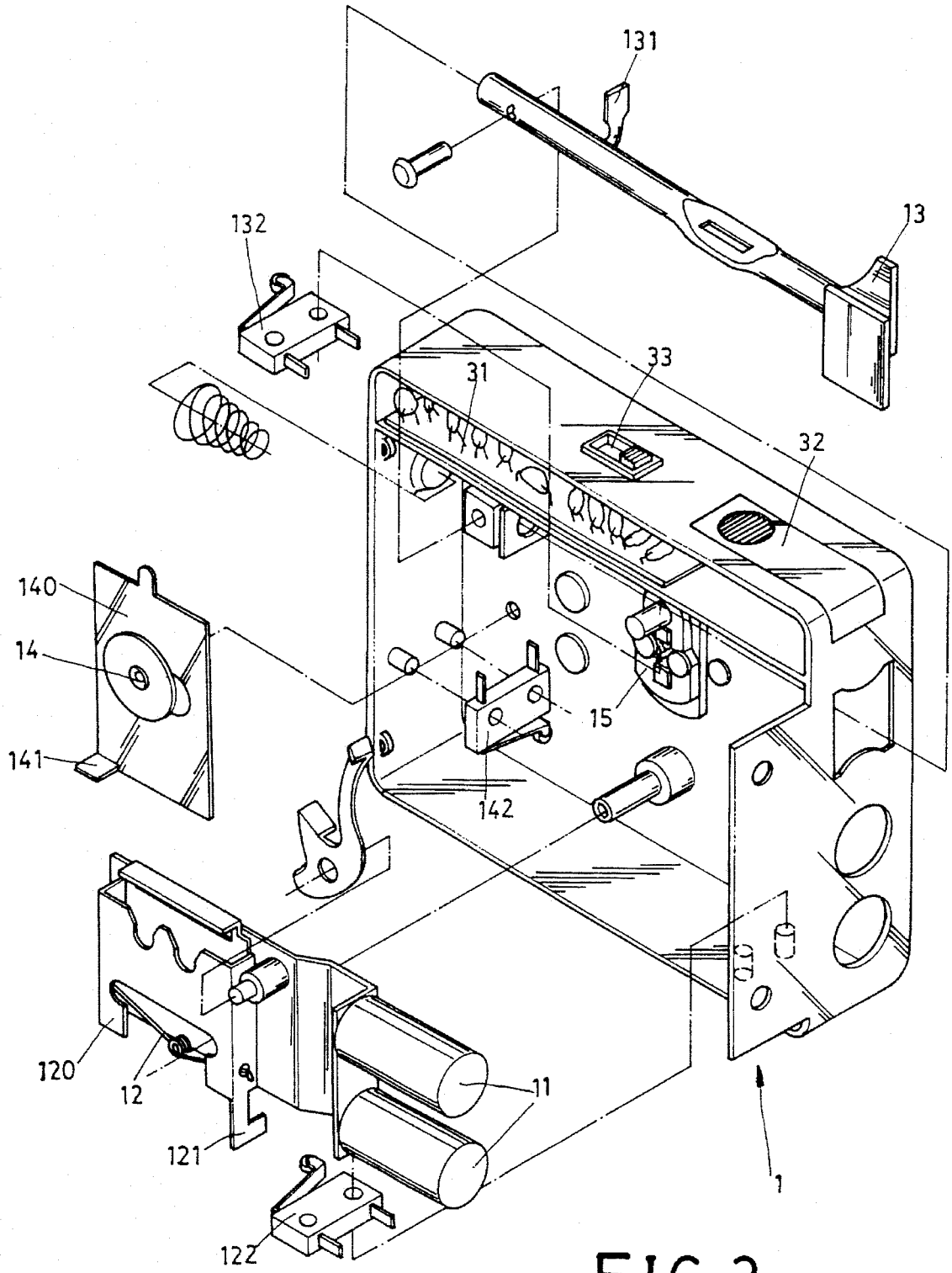
FIG. 3 is a perspective exploded view of the present invention.
Figure 4:
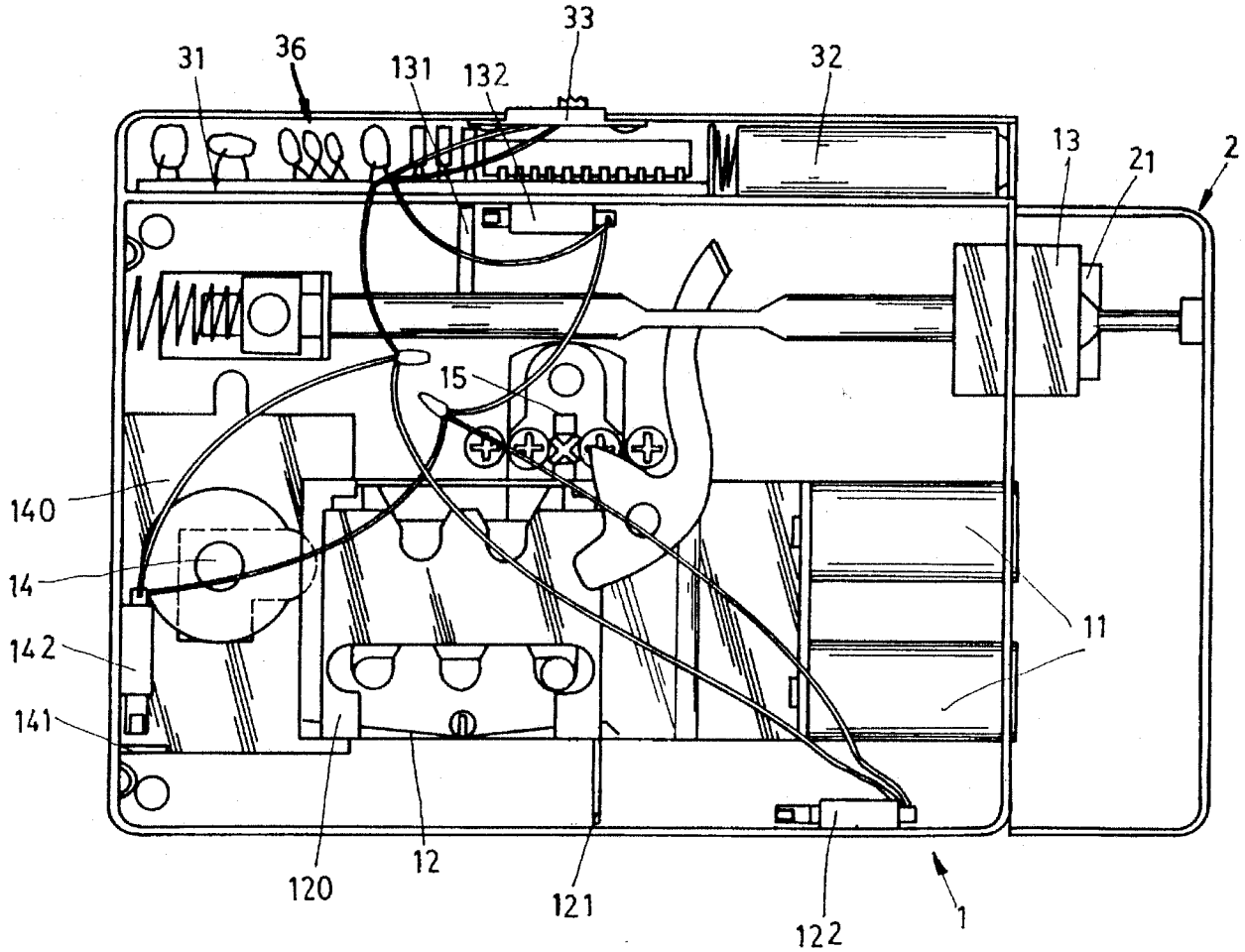
FIG. 4 is a top assembled view of the present invention with the cover removed.
Figure 5:
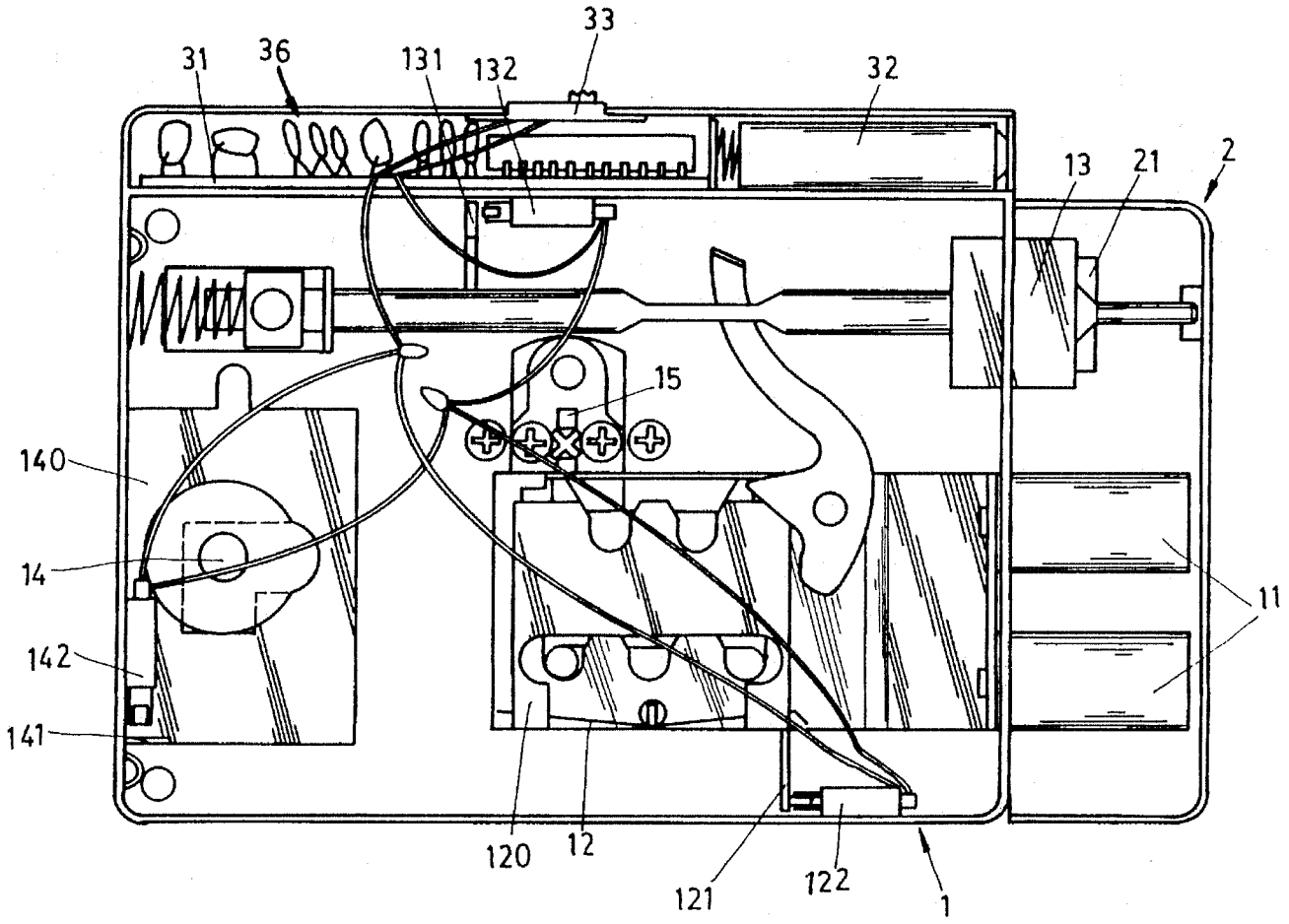
FIG. 5 shows the operation at the first microswitch.
Figure 6:
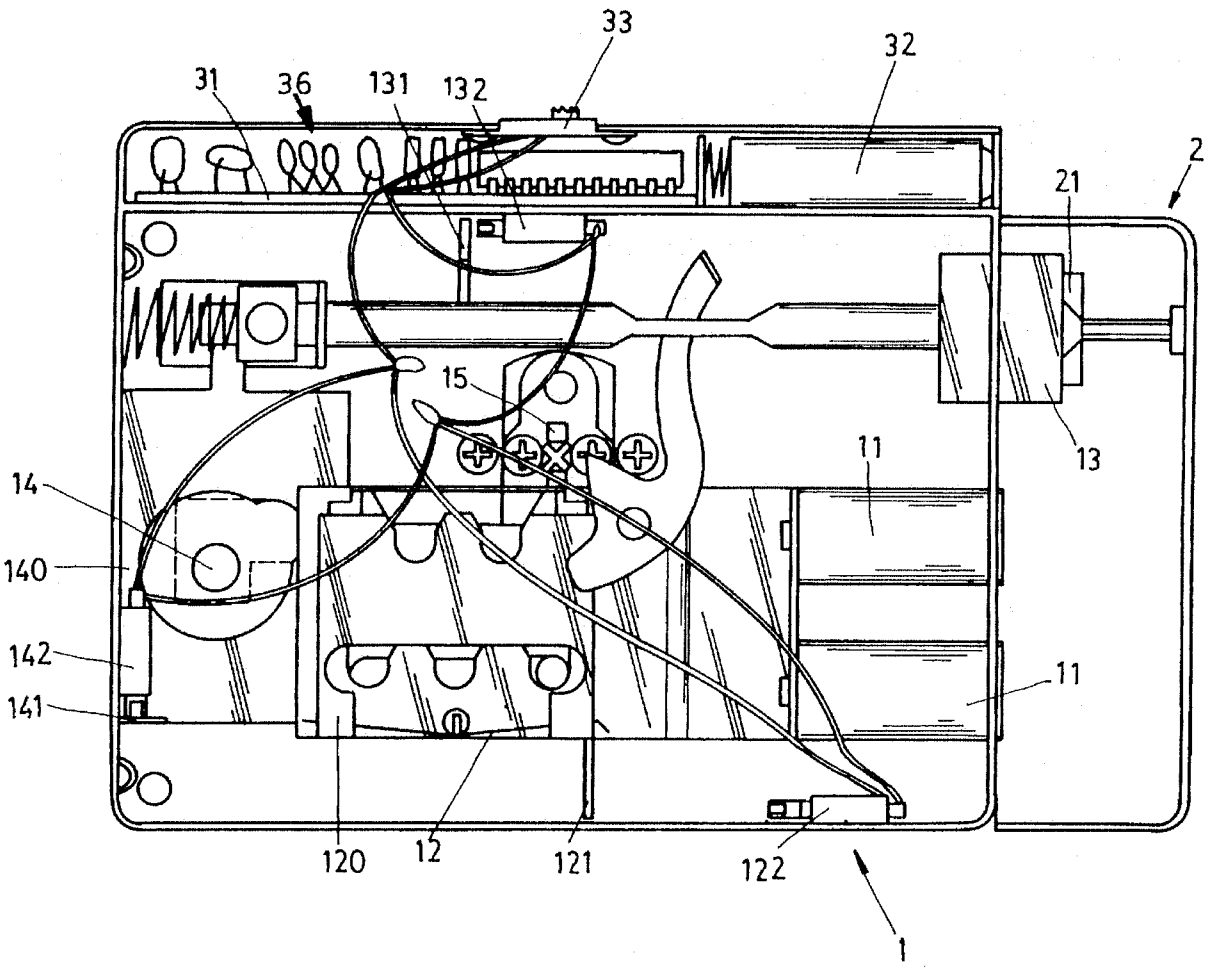
FIG. 6 shows the operation at the second microswitch.
Figure 7:
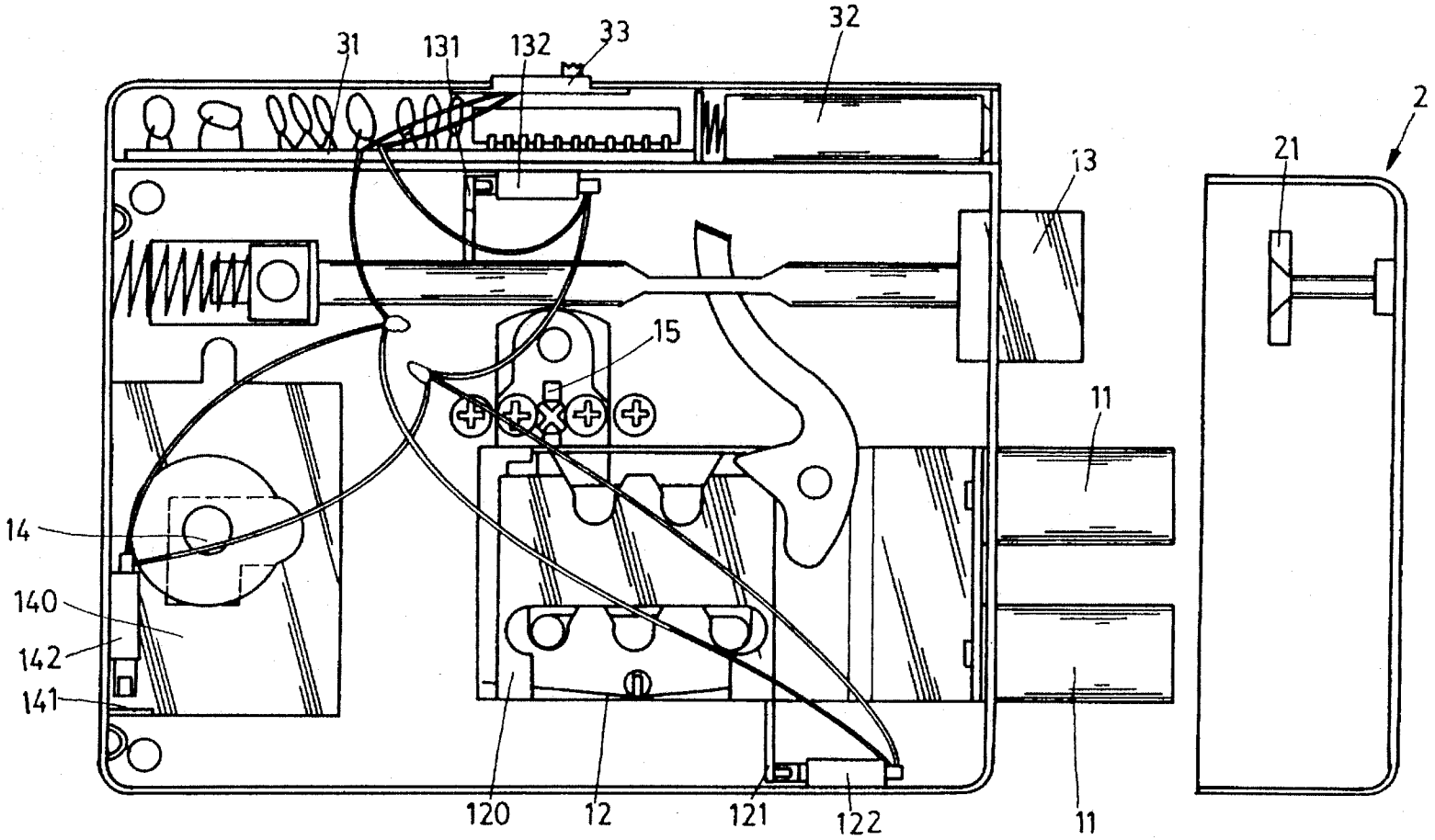
FIG. 7 shows the operation at the third microswitch.
Figure 8:
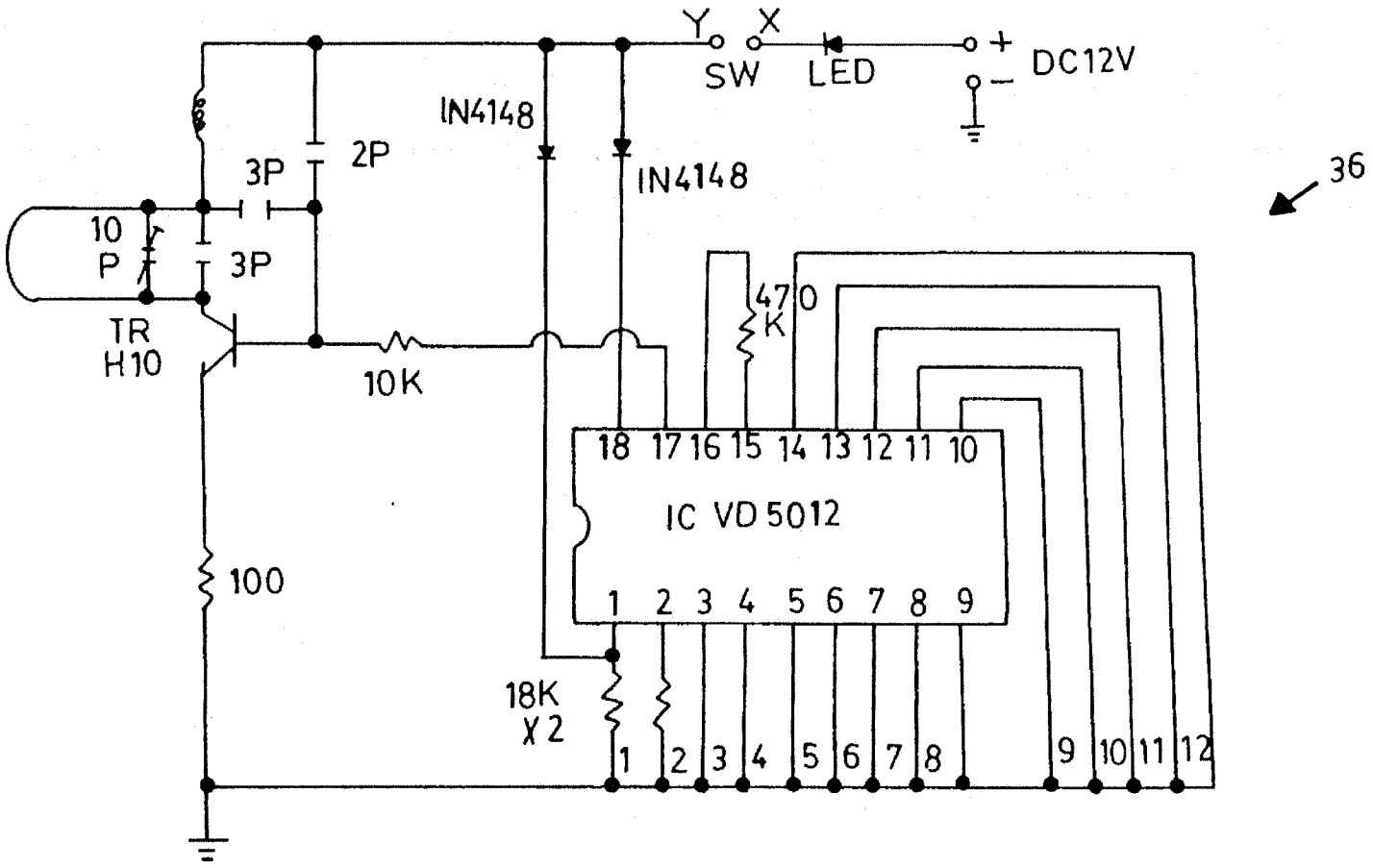
FIG. 8 shows the wire layout of the transmitting means of the present invention.
Figure 9:
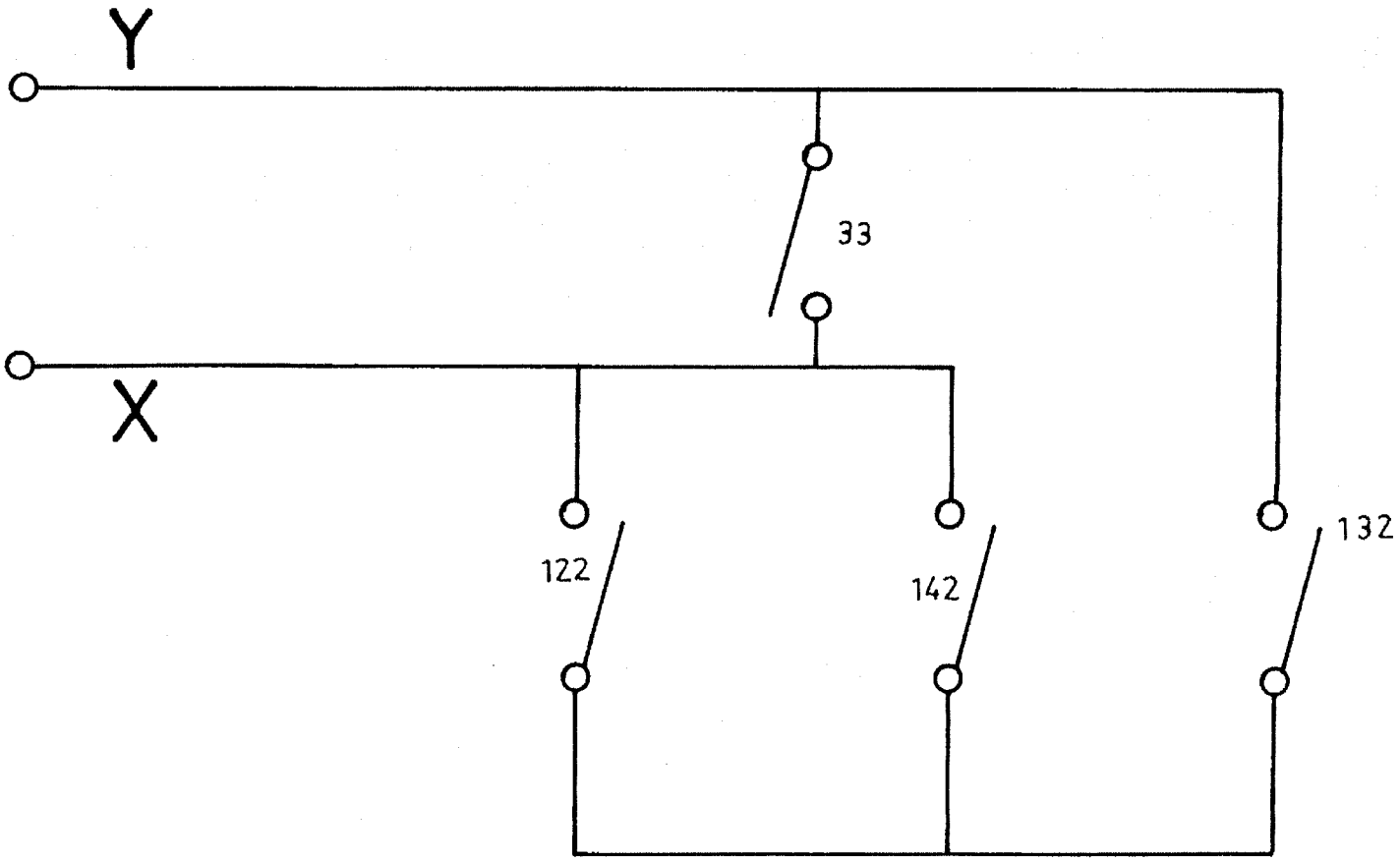
FIG. 9 shows the wire layout of the respective microswitches.
Figure 10:
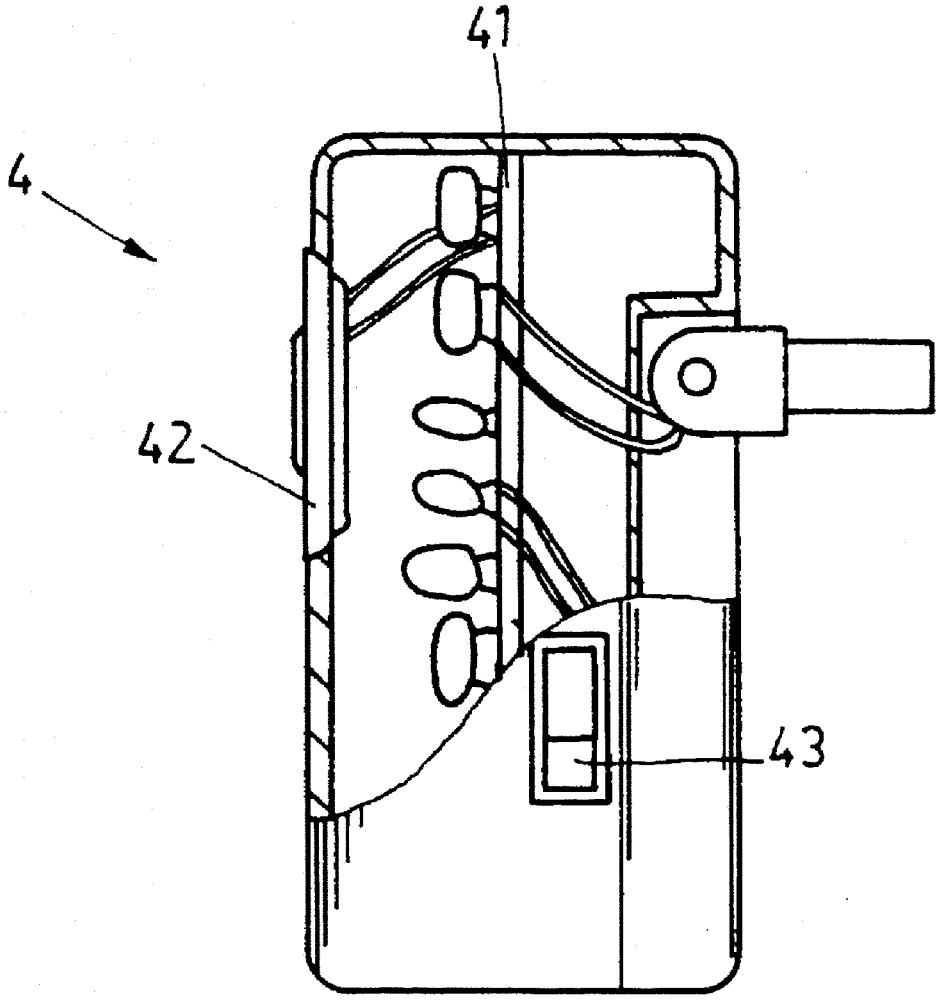
FIG. 10 is a sectional view of the receiving means of the present invention.
Figure 11:
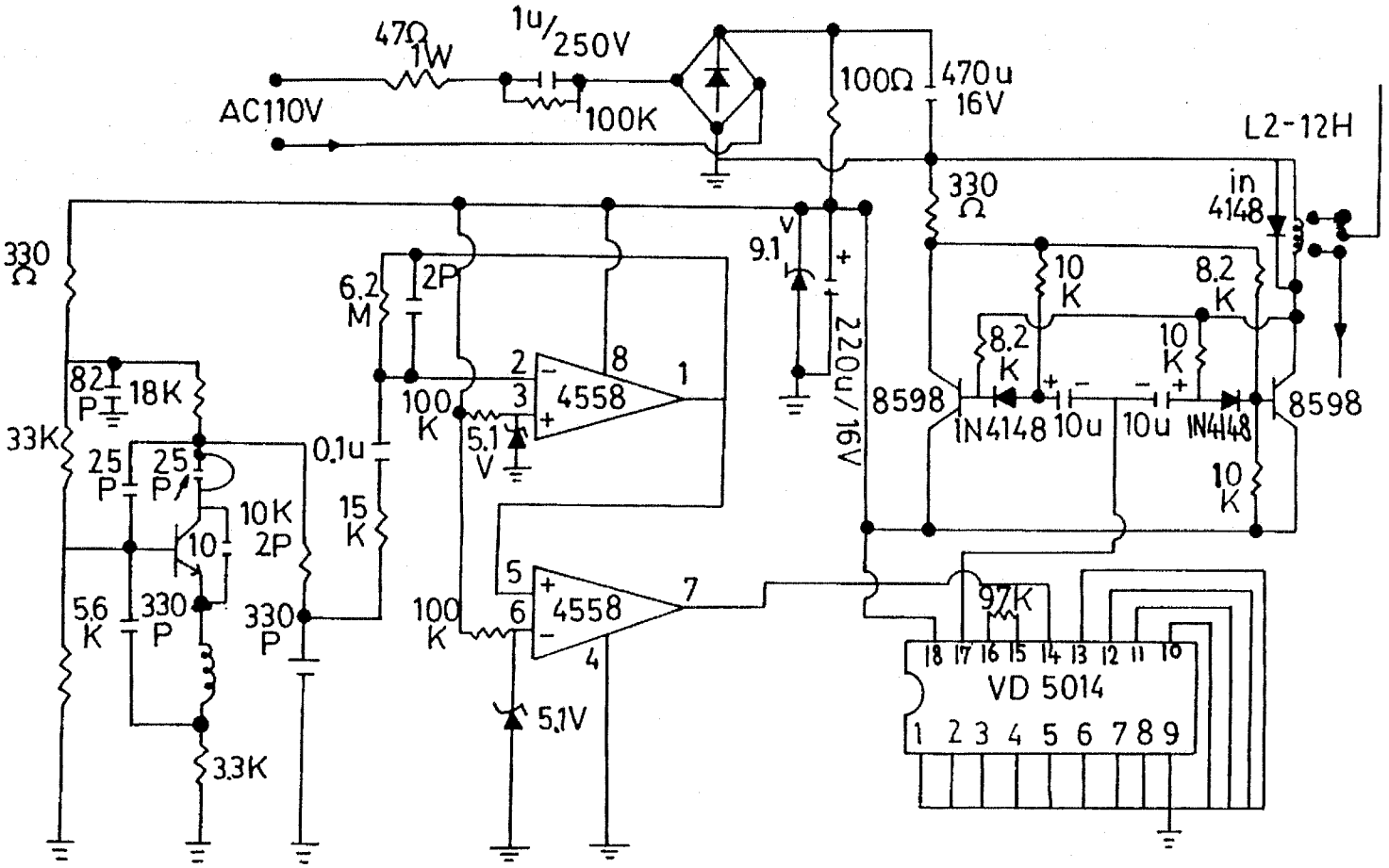
FIG. 11 shows the wire layout of the receiving means.

Please refer to FIGS. 1, 3 and 4. The safety lock of the present invention includes a main lock body 1, a seat member 2, a signal transmitting means 3 and a signal receiving means 4 (see FIG. 2). The transmitting means 3 is disposed on the main lock body 1. The main lock body 1 includes latch pins 11, actuating member 12, deadbolt 13, fixing member 14 and key receiving mechanism 15. A projecting vane plate 121 is integrally stamped near an edge of an upper cover 120 of the actuating member 12. A projecting upright plate 141 is formed on a rear edge of a movable fixing plate 140 of the fixing member 14. A transversely projecting rod 131 is disposed on the deadbolt 13. First, second and third microswitches 122, 142, 132 are respectively disposed on travel end portions of the vane plate 121, upright plate 141 and transverse rod 131 to just contact one another, such that after the latch pins 11 operate, the vane plate 121 of the actuating member 12 contacts and switches on the first microswitch 122, after the fixing member 14 operates, the upright plate 141 of the fixing plate 140 contacts and switches on the second microswitch 142, and after the deadbolt 13 operates, the transverse rod 131 contacts and switches on the third microswitch 132 as shown in FIGS. 5, 6 and 7. A length-microadjustable T-shaped stopping member 21 is disposed on an end edge of the seat member 2 for elastically limiting projection of the deadbolt 13, so that when the deadbolt 13 enters the seat member 2, the stopping member 21 abuts against and stops the deadbolt 13 from totally extending inward. The point at which the transverse rod 131 contacts the third microswitch 132 is adjusted by adjusting the extension length of the stopping member 21, the clearance between the transverse rod 131 and the third microswitch 132 being adjusted so as to avoid false alarms due to unintended collisions with the door or other incidental contact. The transmitting means 3 disposed on the main lock body 1 is provided with inner electronic circuit board 31 and battery 32 for supplying power. A manual switch 33 is disposed on the transmitting means 3. FIG. 9 shows the connection between the switches 122, 142, 132, and 33, while FIG. 8 shows the location of wires X and Y relative to the circuit components 36 which make up the transmitter of the preferred safety lock, with wire X and wire Y extending from the circuit board 31 to connect with the power source and transmit a signal to the receiving means 4. The receiving means 4 is provided with inner electronic receiving system 41, alarm speaker 42 and several manual switches 43 as shown in FIGS. 2 and 10. FIG. 11 shows a circuit arrangement which can be used in the receiving means 4, although the circuit arrangement of the receiving means 4 forms no part of the present invention and those skilled in the art will appreciate that different circuit arrangements can be substituted for both the transmitting and receiving means. A plug 40 is plugged into an indoor socket to connect with the power source. The electronic receiving system 41 receives the alarm signal from the transmitting means 3 and the alarm speaker 42 emits an alarm sound. The several switches 43 are used to control the turning on/off of the receiving means 4 or to instantly actuate the receiving means to emit a test or long duration alarm.

The main lock body 1 is adapted to be mounted on a door while the seat member 2 is disposed on a door frame in cooperation with the main lock body 1 to achieve a three-stage locking effect. Meanwhile, the receiving means 4 is plugged into any indoor socket and the switches 43 are used to select a turning on state of the receiving means. When a user leaves the house and shuts the door, a key is inserted into the key receiving mechanism 15 to control the actuating member 12, causing the latch pins 11 to protrude into the seat member 2. Meanwhile, the vane plate 121 of the upper cover 120 of the actuating member 12 contacts the first microswitch 122 to connect the X wire with the third microswitch 132, forming a standby state. At this time, because the deadbolt 13 is stopped by the stopping member 21 of the seat member 2 and fails to totally extend, the transverse rod 131 fails to contact the third microswitch 132 and connect the X wire and Y wire. Therefore, normally no alarm will take place. Moreover, the stopping member 21 is used to microadjust the clearance between the transverse rod 131 and the third microswitch 132 so that incidental slight touches, collisions, or other causes will not close switch 132 and result in a false alarm. However, in case the main lock body 1 or the door is pried, dug, or detached, or the latch pins 11 and deadbolt 13 are cut, the deadbolt 13 is released from the stopping force of the stopping member 21 and pushed forward to be totally extended by a rearward spring, whereupon, the transverse rod 131 contacts the third microswitch 132 to completely connect the X wire and Y wire and actuate the transmitting means 3 to emit a signal to the receiving means 4. The receiving means 4 receives the signal and immediately actuates the alarm speaker 42 to emit an alarm sound to scare the thief or inform the owner of the situation and allow the owner to react. Alternatively, when the user is in the house and desires to actuate the burglar-proof system, the user can use a key or the fixing member or both to control the same indoors. The fixing member 14 rotates to make a front end of the fixing plate 140 protrude and engage with a rear edge of the deadbolt 13 so as to stop the deadbolt 13 from moving backward and opening the door. Meanwhile, the upright plate 141 of the rear edge of the fixing plate 140 contacts the second microswitch 142 and connects the X wire with the third microswitch 132 to attain the standby state, whereby when the thief breaks the lock or the door, the lock can emit an alarm to achieve burglar-proofing effect.

In addition, the manual switch 33 of the transmitting means 3 and the manual switch 4 of the receiving means 4 can be used to test whether the signal transmission and receiving circuitry and alarm are operating properly. Also, after the thief intrudes into the house, a long duration alarm can be actuated manually. A light or other measures can be used instead of the alarm. Moreover, the receiving means 4 can be mounted in neighbors' houses for assistance. Multiple sets of transmitting means can be disposed on the main lock body 1 to be freely pressed to actuate the alarm system.

It is to be understood that the above description and drawings are only used for illustrating one embodiment of the present invention, not intended to limit the scope thereof. Any variation and derivation from the above description and drawings should be included in the scope of the present invention.

What is claimed is:

1. A safety lock comprising a main lock body, a seat member, a signal transmitting means and a signal receiving means, wherein the transmitting means is disposed on the main lock body, the safety lock being characterized in that the main lock body includes latch pins, actuating member, deadbolt, fixing member and key receiving mechanism, wherein a projecting vane plate is integrally formed at an edge of an upper cover of the actuating member and a projecting upright plate is formed on a rear edge of a movable fixing plate of the fixing member, and a transversely projecting rod is disposed on the deadbolt, a first, a second and a third microswitch being respectively disposed adjacent the travel end portions of the vane plate, upright plate and transverse rod, whereby after the first or second microswitch is contacted and actuated, a standby state is attained, and when the third microswitch is contacted and actuated, the transmitting means is turned on to transmit a signal to the receiving means which thereupon emits an alarm.

2. A safety lock as claimed in claim 1, wherein a length-microadjustable T-shaped stopping member is disposed on an end edge of the seat member for elastically limiting projection of the deadbolt, whereby when the deadbolt enters the seat member, the stopping member abuts and stops the deadbolt from totally extending inward, whereby the transverse rod fails to contact the third microswitch and the clearance between the transverse rod and the third microswitch is adjustable so as to avoid false alarms due to collision, vibration or other incidental contact.

3. A safety lock as claimed in claim 1, wherein additional switches are disposed on the transmitting means and receiving means for directly actuating the same for transmitting a signal and emitting a test or long duration alarm, the receiving means being powered by means of a plug inserted into an indoor socket, and still further switches are provided to selectively turn the safety lock on/off.

* * * * *